United States Patent [19]

Leland

[11] 4,032,238

[45] June 28, 1977

[54] FOUNTAIN PAINT ROLLER

[76] Inventor: Ragnvald G. Leland, P.O. Box 4174, Palm Springs, Calif. 92262

[22] Filed: June 24, 1976

[21] Appl. No.: 699,502

[52] U.S. Cl. ..... 401/197

[51] Int. Cl.[2] ..... B44D 3/28

[58] Field of Search ..... 401/197, 219, 194

[56] References Cited

UNITED STATES PATENTS

| | | | |
|---|---|---|---|
| 3,099,034 | 7/1963 | Leland | 401/197 |
| 3,224,031 | 12/1965 | Leland | 401/197 |
| 3,877,823 | 4/1975 | Leland | 401/197 |

*Primary Examiner*—Lawrence Charles
*Attorney, Agent, or Firm*—Berman, Aisenberg & Platt

[57] ABSTRACT

An improved fountain paint roller which features the utilization of a pair of aperture-containing cylinders which are rotatable relative to one another so as to bring their respective apertures into and out of alignment which, in turn, turns on and off the paint supply located within the inner cylinder. Guide means are formed near the edges of the inner and outer cylinders for establishing the on and off painting positions, and an end closure cap fits the inner cylinder adjacent the same end for containing the paint therein. A single wire handle has a shaft extending through the distal end of the cylinders for permitting relative rotation thereabout. Means are provided for attenuating forces on the end closure cap which results from the paint positioned within the cylinders. A separately provided key fits within notches formed in the end closure cap for effectuating the control of the paint supply through the apertures to an outer applicator pad.

15 Claims, 7 Drawing Figures

KEY

FOUNTAIN PAINT ROLLER

BACKGROUND OF THE INVENTION

1. Field of the Invention

This invention is related to fountain paint rollers and, more particularly, is directed towards improvements in paint rollers of the type which include a self-contained paint supply and which may be periodically refilled as necessary.

2. Description of the Prior Art

Prior art in the field of fountain paint rollers includes the following U.S. Pat. Nos. issued to me: 3,099,034; 3,135,006; 3,224,031; 3,263,264; 3,356,442; and 3,877,823.

The most recent of the foregoing sets forth an interchangeable cartridge for fountain type paint rollers which permits rapid replacement of the paint supply. The design features an inner and outer cylinder, rotatable relative to one another, each having apertures formed therein which are respectively brought into and out of alignment with one another. End closure means are provided, and a handle having a double wire extension which is rotatably secured within apertures formed in the respective end cover members is also featured.

While providing certain advantages over the prior art then known, my earlier patent nevertheless suffers from several deficiencies. One of the deficiencies relates to the design of the end closure cap which requires a person using the paint roller to grasp and turn same in order to control the flow of paint from the inner cylinder through the apertures to an outer applicator pad. Since the end closure cap tended to become covered with paint during use, such a procedure was found to be unduly messy and therefore unattractive.

Another deficiency with respect to my prior art design discussed above was the provision of the two-wire handle which of necessity limited the applicability of the paint roller in close fitting quarters, such as corners, or the like.

It was also found that the volume of paint contained within the inner cylinder tended during painting to create a not insubstantial pressure on the end closure cap of the cylinders, such that means for attenuating or minimizing the effect of such forces were called for.

Generally speaking, the need always exists for providing improved means for preventing accidental leakage and/or spilling of the paint contained within the cylinders.

OBJECTS AND SUMMARY OF THE INVENTION

It is therefore a primary object of the present invention to provide a paint roller of the fountain type which overcomes all of the deficiencies noted above with respect to prior art designs.

Another object of the present invention is to provide an improved fountain paint roller, which is easier to use, less expensive to construct, more versatile in operation, and which provides an overall better performance than prior art designs.

A further object of the present invention is to provide a new and improved fountain paint roller which is far less messy to handle, easier to load paint, and which provides a unique means for controlling paint flow.

An additional object of the present invention is to provide an improved fountain paint roller which incorporates a single wire handle in order to provide better accessibility to tight quarters, such as corners, or the like.

It is a general object of the present invention to provide a new and improved fountain paint roller which incorporates means for decreasing the likelihood of accidental leakage and/or spillage of the paint contained within the cylinders.

A more specific object of the present invention is to provide an improved design for fountain paint rollers which incorporates a unique means for attenuating the interior paint forces in a manner so as to render their effects negligible.

The foregoing and other objects are attained in accordance with one aspect of the present invention through the provision of a fountain paint roller which comprises an outer cylinder having a first set of apertures formed therein, an inner cylinder having a second set of apertures formed therein and being disposed within the outer cylinder so as to be rotatable therewithin between a first position wherein the first and second sets of apertures are not aligned and a second position wherein the sets of apertures are substantially aligned with one another. The paint roller also includes guide means for constraining the rotation of the inner cylinder between the first and second positions, key means for rotating the inner cylinder within the outer cylinder between the first and second positions, and end closure means for the inner cylinder which includes means formed therein for receiving the key means so as to be rotatable thereby.

In a preferred embodiment, the key means comprises a separately formed substantially flat plate member, while the end closure means includes a base and a circumferentially formed flange which is upstanding from the base. The means for receiving the substantially flat key in the form of a plate member comprises a pair of notches which are oppositely disposed in the upstanding flange.

In accordance with other aspects of the present invention, the guide means comprises means disposed adjacent the end of the outer cylinder for engagement with cooperating means formed adjacent the end of the inner cylinder, the last-named means comprising a collar having first and second abutments, the first-named means comprising a flange which extends from the end of the outer cylinder and which moves within the space defined by the first and second abutments. The outer cylinder further includes an end plate formed at its distal end which has a concentrically formed handle-receiving aperture therein.

In accordance with yet other aspects of the present invention, handle means are provided which include a shaft for rotatably supporting the inner and outer cylinders which extends through the shaft-receiving aperture formed in the outer cylinder end plate, said shaft further extending along the axial length of the cylinders to a position adjacent the end closure means.

A sleeve member is also provided which encloses and is rotatable about the shaft, one end of the sleeve member being adjacent the shaft-receiving aperture in the end plate, the distal end of the sleeve including a reduced diameter portion which terminates adjacent the end of the shaft.

In accordance with yet another aspect of the present invention, means in the form of an apertured disc is positioned about the reduced diameter portion of the sleeve member for preventing undue forces resulting from the paint contained within the inner cylinder from impacting the end closure means so as to minimize the possibility of an accidental leak or spillage. A pair of alternative locking means for the end closure cap are also provided, one comprising an elongate spring member whose ends fit within cooperating apertures formed in the upstanding flange of the end closure member, the other being a catch member slidably disposed adjacent the base of the end closure member, and a notch formed in the upstanding flange for receiving the catch member.

BRIEF DESCRIPTION OF THE DRAWINGS

Various objects, features and attendant advantages of the present invention will be more fully appreciated as the same become better understood from the following detailed description thereof when considered in connection with the accompanying drawings, in which.

DETAILED DESCRIPTION OF THE PREFERRED EMBODIMENT

Figure 1:
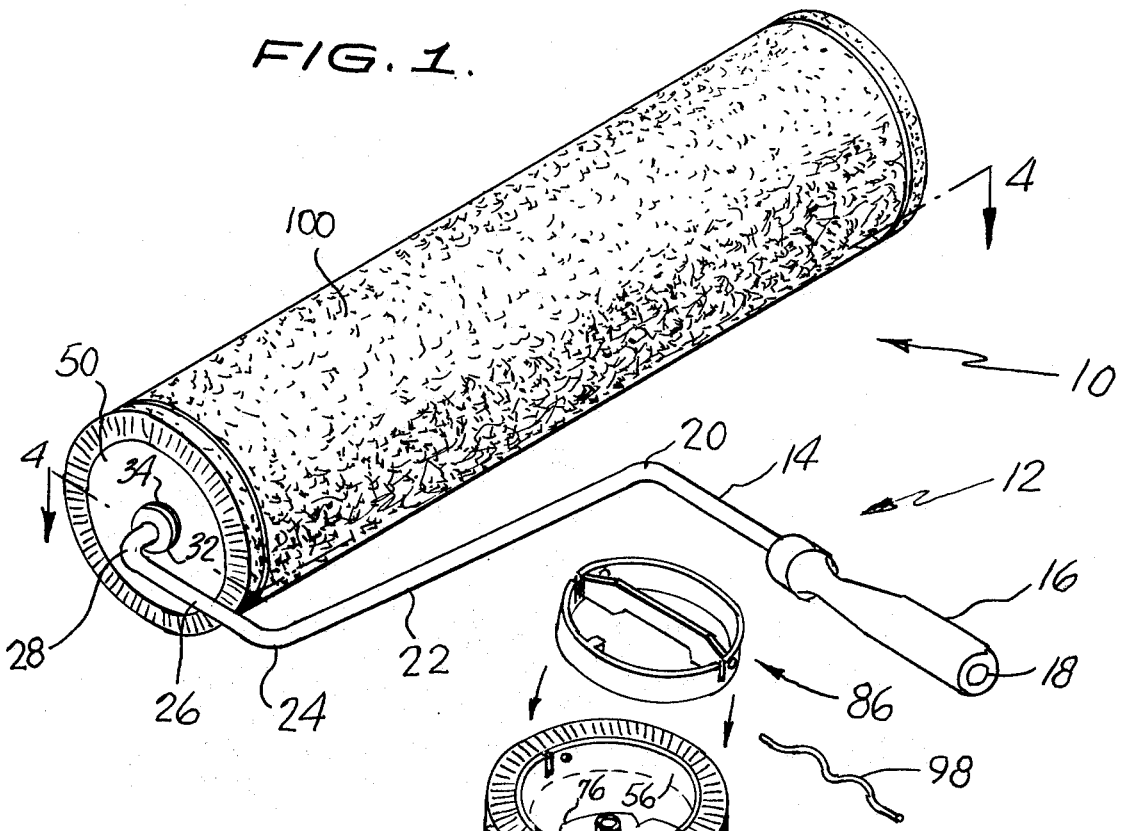
FIG. 1 is a perspective view illustrating a preferred embodiment of the improved fountain paint roller according to the present invention in an assembled form.

Referring now to the drawings, wherein like reference numerals represent identical or corresponding parts throughout the several views, and more particularly to FIG. 1 thereof, there is illustrated in a perspective view a preferred embodiment of the improved fountain paint roller of the present invention indicated generally by the reference numeral 10.

Fountain paint roller 10 includes a handle assembly which is indicated generally by the reference numeral 12. Handle assembly 12 comprises a rod-like main supporting portion 14 about the free end of which positioned a handle grip 16. Handle grip 16 is held in place on main supporting portion 14 by means of a press fit lock nut 18, or the like.

Figures 4, 5, 7:
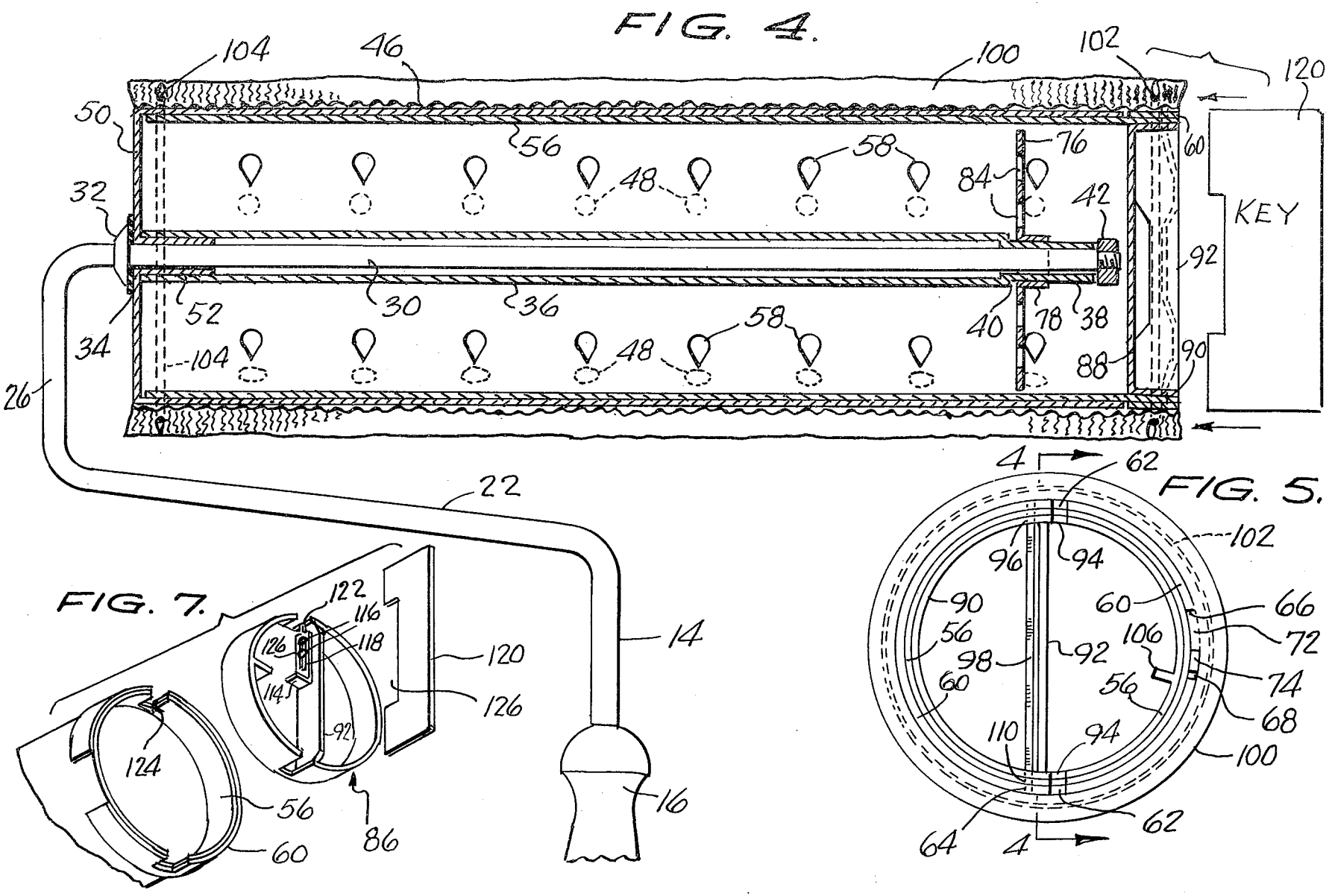
FIG. 4 is a cross-sectional view of the preferred embodiment illustrated in FIG. 1 and taken along line 4—4 thereof.
FIG. 5 is an end view of the preferred embodiment illustrated in FIG. 1.
FIG. 7 is an exploded perspective view illustrating an alternative embodiment of an end closure and locking means in accordance with the teachings of the present invention.
Figure 6:
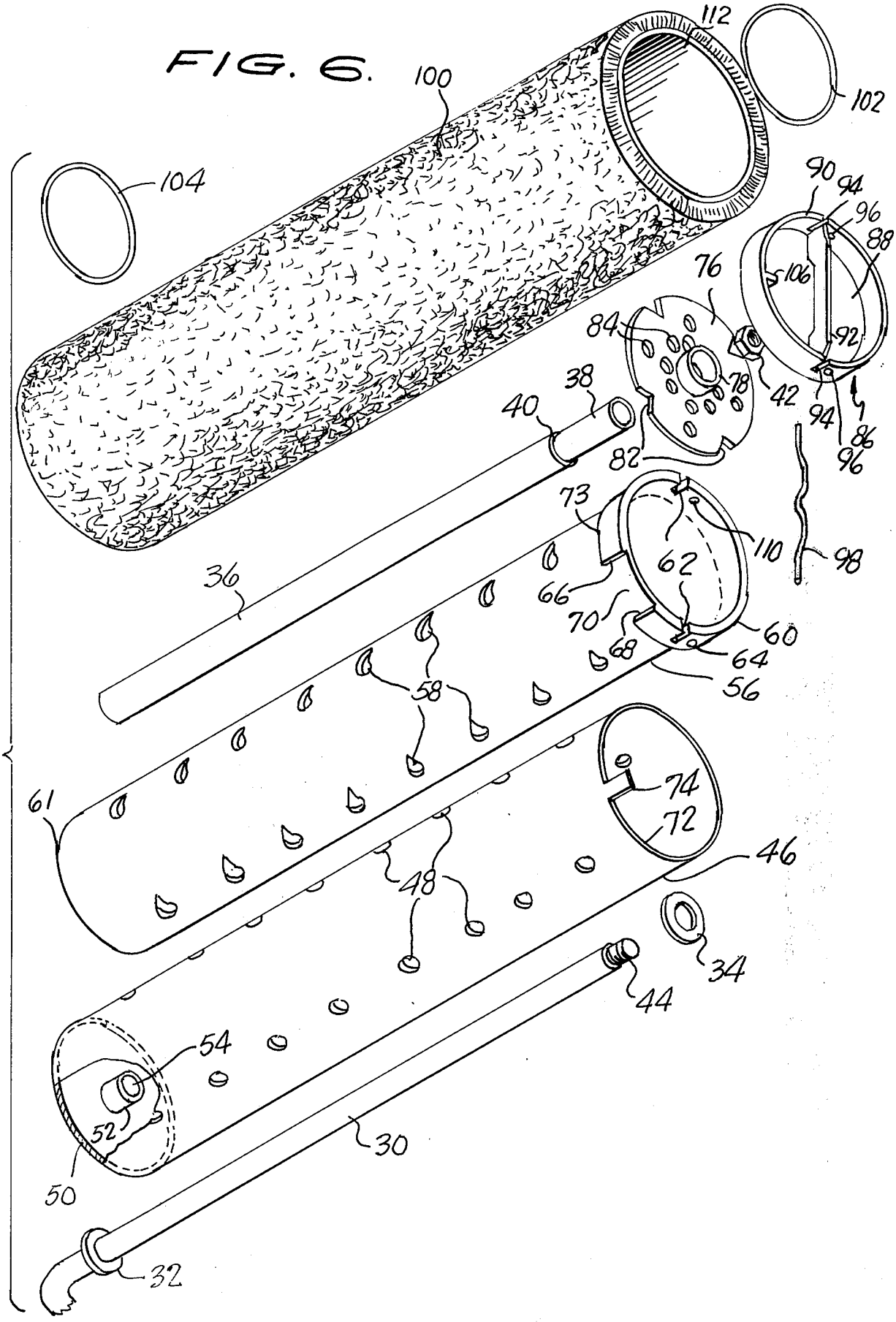
FIG. 6 is an exploded perspective view illustrating the various components comprising the preferred embodiment of the fountain paint roller illustrated in FIG. 1.

The handle assembly 12 includes an arm portion 22 which extends from a right angle bend 20 formed at the distal end of the main supporting portion 14. The other end of arm 22 similarly forms a right angle bend 24 to extend into an arm 26 which is substantially parallel to the rod-like supporting portion 14. The distal end of arm 26 forms a similar right angle bend 28 and extends into an integrally formed main shaft 30 (FIGS. 4 and 6).

Mounted adjacent the right angle bend 28 on shaft 30 is an abutment collar 32 adjacent to which is positioned a seal washer 34. As better viewed in FIGS. 4 and 6, shaft 30 is provided at its distal end with a threaded portion 44 for threadedly receiving a nut 42.

The fountain paint roller 10 includes an outer cylinder 46 which is provided with a plurality of apertures 48 formed on the outer cylinder surface in a regular pattern. Outer cylinder 46 is provided at one end with a preferably integrally formed end cap 50 which has a cylindrical boss 52 which defines an axial opening 54 for receiving shaft 30 therethrough. The distal end of outer cylinder 46 is defined by an open edge 72 having an integrally extending flange 74 formed thereon, for a purpose which will become more clear hereinafter.

Concentrically provided within outer cylinder 46 is a similarly sized inner cylinder 56 which has formed in the cylindrical surface thereof a plurality of apertures 58, arranged in the same regular pattern as those apertures 48 formed in outer cylinder 46. Apertures 58 are preferably of a general keyhole or otherwise tapered configuration so as to enable a steady and continuous control of paint flow therethrough when slowly rotated with respect to the apertures 48 in outer cylinder 46.

One end 61 of inner cylinder 56 is open and substantially abuts the integrally formed end cap 50 of outer cylinder 46 when assembled. The distal end of inner cylinder 56 has a collar 60 formed about substantially the entire circumference thereof, collar 60 extending from one end 66 thereof to the other end 68, as clearly illustrated in FIG. 6. The space between ends 66 and 68 of collar 60 defines a recess 70 within which flange 74 of outer cylinder 46 may move, for a purpose to become more clear hereinafter.

Formed through adjacent portions of inner cylinder 56 and collar 60, in diametrically-opposed locations, are a pair of notches 62 (FIG. 5). Disposed adjacent notches 62 in collar 60 are a pair of opposed substantially circular apertures 64, inner cylinder 56 having a pair of aligned apertures 110 formed therein.

The length of inner cylinder 56 is longer than that of outer cylinder 46 by an amount equal to the height of collar 60 formed at the end of inner cylinder 56. That is, when assembled, open edge 72 of outer cylinder 46 substantially abuts the lower edge 73 of collar 60 so that notch 74 lies in the recess 70.

An elongated tubular member 36 extends about shaft 30 from a point where it abuts end cap 50 about cylindrical boss 52 to a reduced diameter portion 38 whose transition is defined by an integrally formed stop 40.

Formed about the reduced diameter portion 38 of tube 36 is a disc-like member 76 characterized by a substantially flat circular shape having a centrally formed cylindrical boss 78 which defines an aperture. Disc 76 preferably includes a plurality of peripherally formed notches 82 as well as a plurality of apertures or holes 84 formed in the body portion thereof. Disc 76 is designed so as to be freely movable along the length of the reduced diameter portion 38 from the stop 40 to the end thereof which is secured by nut 42. The notches 82 and holes 84 are provided as a means for permitting paint to be communicated to the remainder of the inner cylinder 56 when filling.

An end closure member for inner cylinder 56 comprises a cap which is indicated generally by reference numeral 86 in FIG. 6. Cap 86 comprises a flat closed base plate 88 from the periphery of which extends an upstanding flange 90 which is tightly received within the portion of inner cylinder 56 adjacent collar 60. Cap 86 further comprises a tranversely positioned guide or support link 92 adjacent to which are formed a pair of opposed notches 94 in flange 90 which, when assembled, are in alignment with notches 62 formed in inner cylinder 56 and collar 60. Flange 90 is also provided with a pair of circular oppositely located apertures 96 which similarly become aligned with apertures 64 and 110 formed in collar 60 and inner cylinder 56, respectively.

Positioned adjacent upstanding flange 90 on the inner periphery thereof is a notch indicator 106 which, along with flange 74 of outer cylinder 96, provides an indication as to the relative alignment of the apertures 48 and 58 of cylinders 46 and 56, respectively.

Adapted to be received within apertures 96, 64 and 110 is a cap-holding spring 98 which is utilized in one embodiment as a means for retaining cap 86 onto the end of inner cylinder 56.

Adapted to be received within aligned notches 94 and 62 is a substantially planar key member 120, held by the user, for rotating inner cylinder 56 relative to the outer cylinder 46 for regulating the paint supply through apertures 48, 58 to an applicator pad 100 which is substantially cylindrically shaped and extends along the length of outer cylinder 46, preferably to the rightmost edges of collar 60, as viewed in FIG. 4. Pad 100 may be made out of any suitable natural or synthetic material, such as imitation lamb's wool, and preferably includes a substantially porous inner lining 112 to permit free flow of paint to the outer applicator surface thereof. A pair of elastic members 102 and 104 may be provided one at either end of pad 100 so as to secure the ends thereof against the respective portions of outer cylinder 46 and collar 60 thereadjacent. Elastic members 102 and 104 which may, for example, comprise rubber bands, assist in preventing accidental spillage and/or leakage of paint through the end portions of the apparatus.

Referring now to FIG. 7, an alternative embodiment of the end closure cap 86 is illustrated. In this embodiment, instead of spring holder 98, a slide bar 126 is mounted on transverse support 92. At one end of slide bar 126 is an upstanding flange 114 for gripping same, while at the other end a latch member 122 projects therefrom. Longitudinally formed within slide bar 126 is a slotted portion 118 through which extend a pair of rigid guide post pins 116 connected to transverse support 92. Slide bar 126 is free to reciprocate between a locked position when latch 122 is positioned through a similarly sized notch 124 formed in inner cylinder 56 and adjacent collar 60, and an unlocked position as illustrated in FIG. 7. The key 120 utilized in conjunction with this embodiment is preferably provided with a recessed portion 126 for accommodating slide bar assembly 126 therein during use.

During assembly of the apparatus, tightening of nut 42 on shaft 30 will provide the necessary pressure on sleeve 36 and sealing washer 34 to regulate the free rotation of the cylinders necessary during use about shaft 30. Note that nut 42 is closely positioned against base plate 88 of cap 86 to prevent its accidental dislodging from the end of shaft 30 during use.

FIG. 4 clearly illustrates the provision of disc 76 on the reduced diameter portion 38 of sleeve 36, disc 76 freely moving between stop 40 and nut 42. When cap 86 is removed, apertures 84, as well as notches 82 (FIG. 6) permit paint to be freely poured therethrough to fill the inner confines of cylinder 56. With cap 86 in place, disc 76 serves as a means for attenuating the forces created by the freely sloshing paint positioned within the cylinders. That is, the proximity of disc 76 to base plate 88 of cap 86 insures that the paint, by and large positioned during use to the left of disc 76 as viewed in FIG. 4, will not impact plate 88 with a force sufficient to dislodge same.

FIG. 5 illustrates the relative position of notch indicator 106 of cap 86 and flange 74 of outer cylinder 46 when cap 86 is in its OFF position, i.e. when apertures 48 and 58 are not in alignment as viewed in FIG. 4. In this position, it may be appreciated that flange 74 is substantially adjacent end 68 of collar 60. When it is desired to rotate inner cylinder 56 relative to fixed outer cylinder 46, the user inserts key 120 in the aligned and oppositely disposed notched pairs 62 and 94 and turns same clockwise as viewed in FIG. 5 which brings edge 66 into abutment with flange 74 at the end of rotation. This defines the fully aligned or ON position when the apertures 48 and 58 are in alignment to permit free flow of paint therethrough to the outer applicator pad 100.

Use of key 120 minimizes the possibility of getting paint on the hand of the user, and at the same time provides the requisite torque necessary to rotate the cylinders, such that control of the paint flow may be accomplished in a highly simplified and unmessy manner.

Figure 2:
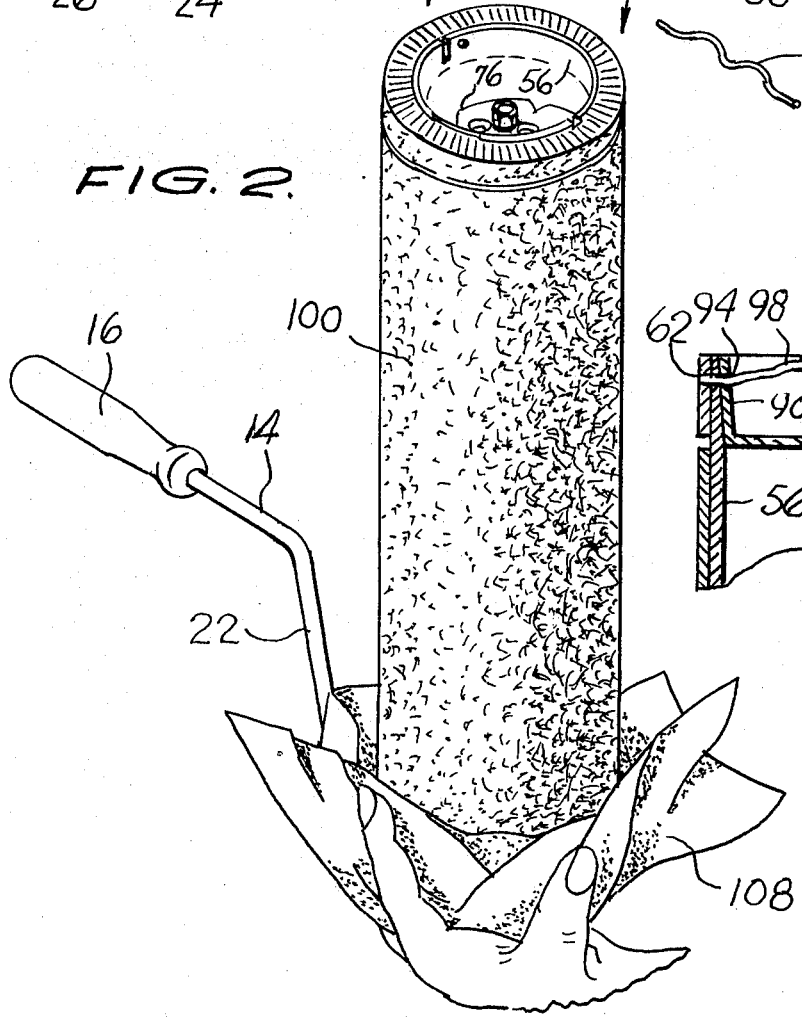
FIG. 2 is another perspective view of the fountain paint roller illustrated in FIG. 1 as it may typically be utilized during a refilling operation.
Figure 3:
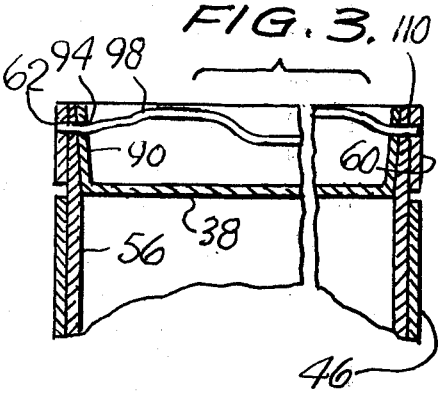
FIG. 3 is an enlarged sectional view, partly cut-away, which illustrates in greater detail one embodiment of the end closure and locking means in accordance with the teachings of the present invention.

When it is desired to add paint to the inner cylinder 56, the paint roller 10 of the present invention may be placed on its end as illustrated in FIG. 2, preferably on a towel or napkin 108. The edge of key 120 may be utilized to push down the outer periphery of pad 100, the approximate half-inch necessary to expose the notches 62, 94. The inner and outer cylinders may then be rotatably adjusted by key 120 to their OFF position (FIG. 5). Cap 86 may then be lifted with the aid of key 120 and paint may be poured within inner cylinder 56 as desired. The cap 86 may then be replaced, pad 100 repositioned, and the inner and outer cylinders rotated with the aid of key 120 to their ON position, ready for painting.

Obviously, numerous modifications and variations of the present invention are possible in light of the above teachings. It is therefore to be understood that within the scope of the appended claims the invention may be practiced otherwise than as specifically described herein.

I claim as my invention:

1. A fountain paint roller, which comprises:

an outer cylinder having a first set of apertures formed therein;

an inner cylinder having a second set of apertures formed therein and being disposed within said outer cylinder so as to be rotatable therewithin between a first position wherein said first and second sets of apertures are not aligned and a second position wherein said sets of apertures are substantially aligned;

guide means for constraining the rotation of said inner cylinder between said first and second positions;

key means for rotating said inner cylinder within said outer cylinder between said first and second positions; and end closure means for said inner cylinder including means formed therein for receiving said key means so as to be rotatable thereby.

2. The fountain paint roller as set forth in claim 1, wherein said key means comprises a substantially flat plate member.

3. The fountain paint roller as set forth in claim 2, wherein said end closure means includes a base, a circumferentially formed flange upstanding from said base, said means for receiving said key means comprising a pair of notches oppositely disposed in said upstanding flange.

4. The fountain paint roller as set forth in claim 1, wherein said guide means comprises means disposed adjacent the end of said outer cylinder for engagement with cooperating means formed adjacent the end of said inner cylinder.

5. The fountain paint roller as set forth in claim 4, wherein said means formed adjacent the end of said inner cylinder comprises a collar having first and second abutments, and wherein said means disposed adjacent the end of said outer cylinder comprises a flange extending from the said end of said cylinder for movement within the space defined by said first and second abutments.

6. The fountain paint roller as set forth in claim 5, wherein said outer cylinder further includes an end plate formed at the distal end thereof and having a handle-receiving aperture means formed therein.

7. The fountain paint roller as set forth in claim 1 further comprising handle means including a shaft for rotatably supporting said inner and outer cylinders and a cover plate positioned over an end of said outer cylinder including a shaftreceiving aperture formed therein, said shaft extending through said shaft-receiving aperture along the axial length of said cylinders to a position adjacent said end closure means.

8. The fountain paint roller as set forth in claim 7 further comprising a sleeve member enclosing and rotatable about said shaft, one end of said sleeve member being adjacent said shaft-receiving aperture, the distal end thereof including a reduced diameter portion terminating adjacent the end of said shaft.

9. The fountain paint roller as set forth in claim 8 further comprising disc means positioned about said reduced diameter portion of said sleeve member for preventing undue forces resulting from the paint contained within said inner cylinder from impacting said end closure means.

10. The fountain paint roller as set forth in claim 9, wherein said disc means includes apertures formed therein.

11. The fountain paint roller as set forth in claim 1 further comprising means positioned within said inner cylinder for preventing undue forces resulting from the paint contained within said inner cylinder from impacting said end closure means.

12. The fountain paint roller as set forth in claim 11, wherein said force-preventing means comprises a disc-like member positioned about a shaft axially located within said cylinders, said disc-like member including a plurality of apertures formed therein for permitting limited movement of paint therethrough.

13. The fountain paint roller as set forth in claim 3, wherein said end closure means includes means for retaining same on an end of said inner cylinder.

14. The fountain paint roller as set forth in claim 13, wherein said retaining means comprises an elongate spring member whose ends fit within cooperating apertures formed in said upstanding flange of said end closure member.

15. The fountain paint roller as set forth in claim 13, wherein said retaining mean comprises a catch member slidably disposed adjacent the base of said end closure member, and a notch formed in said upstanding flange for receiving said catch member.

* * * * *